US007873511B2

(12) United States Patent
Herre et al.

(10) Patent No.: US 7,873,511 B2
(45) Date of Patent: Jan. 18, 2011

(54) AUDIO ENCODER, AUDIO DECODER AND AUDIO PROCESSOR HAVING A DYNAMICALLY VARIABLE WARPING CHARACTERISTIC

(75) Inventors: Juergen Herre, Buckenhof (DE); Bernhard Grill, Lauf (DE); Markus Multrus, Nuremberg (DE); Stefan Bayer, Nuremberg (DE); Ulrich Kraemer, Ilmenau (DE); Jens Hirschfeld, Heringen (DE); Stefan Wabnik, Ilmenau (DE); Gerald Schuller, Erfurt (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 1237 days.

(21) Appl. No.: 11/428,297

(22) Filed: Jun. 30, 2006

(65) Prior Publication Data

US 2008/0004869 A1 Jan. 3, 2008

(51) Int. Cl.
*G10L 19/14* (2006.01)
*G10L 19/00* (2006.01)
*G10L 19/02* (2006.01)

(52) U.S. Cl. ..... 704/205; 704/200.1; 704/219; 704/227; 704/229

(58) Field of Classification Search ..... None
See application file for complete search history.

(56) References Cited

U.S. PATENT DOCUMENTS 6,496,794 B1 * 12/2002 Kleider et al. ..... 704/201
6,523,002 B1 * 2/2003 Gao et al. ..... 704/207
6,691,084 B2 * 2/2004 Manjunath et al. ..... 704/221
6,850,884 B2 * 2/2005 Gao et al. ..... 704/224
6,978,241 B1 * 12/2005 Sluijter et al. ..... 704/503
7,110,953 B1 * 9/2006 Edler et al. ..... 704/200.1
7,146,324 B2 * 12/2006 Den Brinker et al. ..... 704/500
7,433,815 B2 * 10/2008 Jabri et al. ..... 704/203
2005/0249272 A1 * 11/2005 Kirkeby et al. ..... 375/232
2007/0100607 A1 * 5/2007 Villemoes ..... 704/207
2007/0147518 A1 * 6/2007 Bessette ..... 375/243

OTHER PUBLICATIONS

Schuller et al. "Perceptual audio coding using adaptive pre- and post-filters and lossless compression," IEEE transations on speech and audio processing, vol. 10, No. 6, Sep. 2002.*

(Continued)

*Primary Examiner*—Matthew J Sked
(74) *Attorney, Agent, or Firm*—Glenn Patent Group; Michael A. Glenn

(57) ABSTRACT

An audio encoder, an audio decoder or an audio processor includes a filter for generating a filtered audio signal, the filter having a variable warping characteristic, the characteristic being controllable in response to a time-varying control signal, the control signal indicating a small or no warping characteristic or a comparatively high warping characteristic. Furthermore, a controller is connected for providing the time-varying control signal, which depends on the audio signal. The filtered audio signal can be introduced to an encoding processor having different encoding algorithms, one of which is a coding algorithm adapted to a specific signal pattern. Alternatively, the filter is a post-filter receiving a decoded audio signal.

50 Claims, 8 Drawing Sheets

OTHER PUBLICATIONS

Wabnik et al. "Frequency Warping in Low Delay Audio Coding," Acoustics, Speech, and Signal Processing, 2005. Proceedings. (ICASSP '05). IEEE International Conference on, On pp. iii/181-iii/184 vol. 3, Mar. 18-23, 2005.*
X Wang, S Zahorian, S Auberg, "Analysis of speech segments using variable spectral/temporal resolution," In Proceedings of the International Conference on Spoken Language Processing (1996).*
Karjalainen, et al.; "Realizable Warped IIR Filters and Their Properties"; 1997; IEEE I-CASSP, vol. 3, pp. 2205-2208.
Harma, et al.; "Warped Low-Delay CELP for Wideband Audio Coding"; 1996; Proceedings ICSLP, pp. 318-321.
Koishida, et al.; "CELP Coding Based on Mel-Cepstral Analysis"; 1995; Proceedings IEEE ICASSP pp. 22-36.
Schuijers, et al.; "Advances in Parametric Coding for High-Quality Audio"; 2003; 114th Convention, Amsterdam, The Netherlands.
Smith, et al.; "BARK and ERB Bilinear Transforms"; Nov. 1999; IEEE Transactions on Speech and Audio Processing, vol. 7, Issue 6, pp. 697-708.
Tokuda, et al.; "Speech Coding Based on Adaptive Mel-Cepstral Analysis"; Apr. 1994; Proceedings IEEE ICASSP, pp. 197-200.
Edler, B, et al. Audio Coding Using a Psychoacoustic Pre- and Post-Filter. IEEE 2000.
Harma, A., et al. Frequency-Warped Signal Processing for Audio Applications. J. Audio Eng. Soc. vol. 48. No. 11. Nov. 2000.
Koishia, K., et al. A Wideband Celp Speech Coder at 16 kbit/s Based on Mel-Generalized Cepstral Analysis. IEEE 1998.
Koishida, K., et al. Celp Coding System Based on Mel-Generalized Cepstral Analysis.
Schuller, G., et al. Perceptual Audio Coding Using Adaptive Pre- and Post Filters and Lossless Compression. IEEE Transactions on Speech and Audio Processing. vol. 10. No. 6. Sep. 2002.
Wabnik, S., et al. Frequency Warping in Low Delay Audio Coding. IEEE 2005.
Vary, P, et al. Digital Speech Transmission. Enhancement, Coding, and Error concealment.
Zwicker, E., et al. Psychoacuostics Facts and Models.
Tancerel, L., et al., "Combined Speech and Audio Coding by Discrimination," 2000, Piscataway, NJ, Speech Coding, IEEE Workshop Proceedings.
Chang, Joon-Hyuk, et al., "Speech Enhancement Using Warped Discrete Cosine Transform," Oct. 6, 2002, Piscataway, NJ, Speech Coding, IEEE Workshop Proceedings.
Joon-Hyuk Chang et al., "Speech Enhancement Using Warped Discrete Cosie Transform", IEEE Workshop Proceedings Oct. 6-9, 2002, IEEE, Oct. 6, 2002, pp. 175-177, XP010647252.
Tancerel L. et al., "Combined Speech and Audio Coding by Discrimination", IEEE Workshop Proceedings Sep. 17-20, 2002, IEEE Sep. 17, 2000, pp. 154-156, XP010520073.

* cited by examiner

FIR structure $$D(z) = \frac{z^{-1}-\lambda}{1-\lambda z^{-1}}$$

$\beta_0, \beta_1, \beta_2, \ldots$ prefilter coefficients z: time-varying warping factor (pior art) (time-varying)

(prior art)

(prior art)

(prior art)

AUDIO ENCODER, AUDIO DECODER AND AUDIO PROCESSOR HAVING A DYNAMICALLY VARIABLE WARPING CHARACTERISTIC

FIELD OF THE INVENTION

The present invention relates to audio processing using warped filters and, particularly, to multi-purpose audio coding.

BACKGROUND OF THE INVENTION AND PRIOR ART

In the context of low bitrate audio and speech coding technology, several different coding techniques have traditionally been employed in order to achieve low bitrate coding of such signals with best possible subjective quality at a given bitrate. Coders for general music/sound signals aim at optimizing the subjective quality by shaping spectral (and temporal) shape of the quantization error according to a masking threshold curve which is estimated from the input signal by means of a perceptual model ("perceptual audio coding"). On the other hand, coding of speech at very low bit rates has been shown to work very efficiently when it is based on a production model of human speech, i.e. employing Linear Predictive Coding (LPC) to model the resonant effects of the human vocal tract together with an efficient coding of the residual excitation signal.

As a consequence of these two different approaches, general audio coders (like MPEG-1 Layer 3, or MPEG-2/4 Advanced Audio Coding, AAC) usually do not perform as well for speech signals at very low data rates as dedicated LPC-based speech coders due to the lack of exploitation of a speech source model. Conversely, LPC-based speech coders usually do not achieve convincing results when applied to general music signals because of their inability to flexibly shape the spectral envelope of the coding distortion according to a masking threshold curve. It is the object of the present invention to provide a concept that combines the advantages of both LPC-based coding and perceptual audio coding into a single framework and thus describes unified audio coding that is efficient for both general audio and speech signals.

The following section describes a set of relevant technologies which have been proposed for efficient coding of audio and speech signals.

Perceptual Audio Coding (FIG. 9)

Traditionally, perceptual audio coders use a filterbank-based approach to efficiently code audio signals and shape the quantization distortion according to an estimate of the masking curve.

FIG. 9 shows the basic block diagram of a monophonic perceptual coding system. An analysis filterbank is used to map the time domain samples into sub sampled spectral components.

Dependent on the number of spectral components, the system is also referred to as a subband coder (small number of subbands, e.g. 32) or a filterbank-based coder (large number of frequency lines, e.g. 512). A perceptual ("psycho-acoustic") model is used to estimate the actual time dependent masking threshold. The spectral ("subband" or "frequency domain") components are quantized and coded in such a way that the quantization noise is hidden under the actual transmitted signal and is not perceptible after decoding. This is achieved by varying the granularity of quantization of the spectral values over time and frequency.

As an alternative to the entirely filterbank-based-based perceptual coding concept, coding based on the pre-/post-filtering approach has been proposed much more recently as shown in FIG. 10.

In [Edl00], a perceptual audio coder has been proposed which separates the aspects of irrelevance reduction (i.e. noise shaping according to perceptual criteria) and redundancy reduction (i.e. obtaining a mathematically more compact representation of information) by using a so-called pre-filter rather than a variable quantization of the spectral coefficients over frequency. The principle is illustrated in the following figure. The input signal is analyzed by a perceptual model to compute an estimate of the masking threshold curve over frequency. The masking threshold is converted into a set of pre-filter coefficients such that the magnitude of its frequency response is inversely proportional to the masking threshold. The pre-filter operation applies this set of coefficients to the input signal which produces an output signal wherein all frequency components are represented according to their perceptual importance ("perceptual whitening"). This signal is subsequently coded by any kind of audio coder which produces a "white" quantization distortion, i.e. does not apply any perceptual noise shaping. Thus, the transmission/storage of the audio signal includes both the coder's bit-stream and a coded version of the pre-filtering coefficients. In the decoder, the coder bit-stream is decoded into an intermediate audio signal which is then subjected to a post-filtering operation according to the transmitted filter coefficients. Since the post-filter performs the inverse filtering process relative to the pre-filter, it applies a spectral weighting to its input signal according to the masking curve. In this way, the spectrally flat ("white") coding noise appears perceptually shaped at the decoder output, as intended.

Since in such a scheme perceptual noise shaping is achieved via the pre-/post-filtering step rather than frequency dependent quantization of spectral coefficients, the concept can be generalized to include non-filterbank-based coding mechanism for representing the pre-filtered audio signal rather than a filterbank-based audio coder. In [Sch02] this is shown for time domain coding kernel using predictive and entropy coding stages.

[Edl00] B. Edler, G. Schuller: "Audio coding using a psychoacoustic pre- and post-filter", ICASSP 2000, Volume 2, 5-9 Jun. 2000 Page(s):II881-II884 vol. 2

[Sch02] G. Schuller, B. Yu, D. Huang, and B. Edler, "Perceptual Audio Coding using Adaptive Pre- and Post-Filters and Lossless Compression", IEEE Transactions on Speech and Audio Processing, September 2002, pp. 379-390

In order to enable appropriate spectral noise shaping by using pre-/post-filtering techniques, it is important to adapt the frequency resolution of the pre-/post-filter to that of the human auditory system. Ideally, the frequency resolution would follow well-known perceptual frequency scales, such as the BARK or ERB frequency scale [Zwi]. This is especially desirable in order to minimize the order of the pre-/post-filter model and thus the associated computational complexity and side information transmission rate.

The adaptation of the pre-/post-filter frequency resolution can be achieved by the well-known frequency warping concept [KHL97]. Essentially, the unit delays within a filter structure are replaced by (first or higher order) allpass filters which leads to a non-uniform deformation ("warping") of the frequency response of the filter. It has been shown that even by using a first-order allpass filter $$\left(\text{e.g. } \frac{z^{-1}-\lambda}{1-\lambda z^{-1}}\right),$$

a quite accurate approximation of perceptual frequency scales is possible by an appropriate choice of the allpass coefficients [SA99]. Thus, most known systems do not make use of higher-order allpass filters for frequency warping. Since a first-order allpass filter is fully determined by a single scalar parameter (which will be referred to as the "warping factor" $-1<\lambda<1$), which determines the deformation of the frequency scale. For example, for a warping factor of $\lambda=0$, no deformation is effective, i.e. the filter operates on the regular frequency scale. The higher the warping factor is chosen, the more frequency resolution is focused on the lower frequency part of the spectrum (as it is necessary to approximate a perceptual frequency scale), and taken away from the higher frequency part of the spectrum). This is shown in FIG. 5 for both positive and negative warping coefficients:

Using a warped pre-/post-filter, audio coders typically use a filter order between 8 and 20 at common sampling rates like 48 kHz or 44.1 kHz [WSKH05]

Several other applications of warped filtering have been described, e.g. modeling of room impulse responses [HKS00] and parametric modeling of a noise component in the audio signal (under the equivalent name Laguerre/Kauz filtering) [SOB03]

[Zwi] Zwicker, E. and H. Fastl, "Psychoacoustics, Facts and Models", Springer Verlag, Berlin

[KHL97] M. Karjalainen, A. Härmä, U. K. Laine, "Realizable warped IIR filters and their properties", IEEE I-CASSP 1997, pp. 2205-2208, vol. 3

[SA99] J. O. Smith, J. S. Abel, "BARK and ERE Bilinear Transforms", IEEE Transactions on Speech and Audio Processing, Volume 7, Issue 6, November 1999, pp. 697-708

[HKS00] Härmä, Aki; Karjalainen, Matti; Savioja, Lauri; Vãlimäki, Vesa; Laine, Unto K.; Huopaniemi, Jyri, "Frequency-Warped Signal Processing for Audio Applications", Journal of the AES, Volume 48 Number 11 pp. 1011-1031; November 2000

[SOB03] E. Schuijers, W. Oomen, B. den Brinker, J. Breebaart, "Advances in Parametric Coding for High-Quality Audio", 114th Convention, Amsterdam, The Netherlands 2003, preprint 5852

[WSKH05] S. Wabnik, C. Schuller, U. Krämer, J. Hirschfeld, "Frequency Warping in Low Delay Audio Coding", IEEE International Conference on Acoustics, Speech, and Signal Processing, Mar. 18-23, 2005, Philadelphia, Pa., USA LPC-Based Speech Coding Traditionally, efficient speech coding has been based on Linear Predictive Coding (LPC) to model the resonant effects of the human vocal tract together with an efficient coding of the residual excitation signal [VM06]. Both LPC and excitation parameters are transmitted from the encoder to the decoder. This principle is illustrated in the following figure (encoder and decoder).

Over time, many methods have been proposed with respect to an efficient and perceptually convincing representation of the residual (excitation) signal, such as Multi-Pulse Excitation (MPE), Regular Pulse Excitation (RPE), and Code-Excited Linear Prediction (CELP).

Linear Predictive Coding attempts to produce an estimate of the current sample value of a sequence based on the observation of a certain number of past values as a linear combination of the past observations. In order to reduce redundancy in the input signal, the encoder LPC filter "whitens" the input signal in its spectral envelope, i.e. its frequency response is a model of the inverse of the signal's spectral envelope. Conversely, the frequency response of the decoder LPC filter is a model of the signal's spectral envelope. Specifically, the well-known auto-regressive (AR) linear predictive analysis is known to model the signal's spectral envelope by means of an all-pole approximation.

Typically, narrow band speech coders (i.e. speech coders with a sampling rate of 8 kHz) employ an LPC filter with an order between 8 and 12. Due to the nature of the LPC filter, a uniform frequency resolution is effective across the full frequency range. This does not correspond to a perceptual frequency scale.

Warped LPC Coding

Noticing that a non-uniform frequency sensitivity, as it is offered by warping techniques, may offer advantages also for speech coding, there have been proposals to substitute the regular LPC analysis by warped predictive analysis. Specifically, [TML94] proposes a speech coder that models the speech spectral envelope by cepstral coefficients c(m) which are updated sample by sample according to the time-varying input signal. The frequency scale of the model is adapted to approximate the perceptual MEL scale [Zwi] by using a first order all-pass filter instead of the usual unit delay. A fixed value of 0.31 for the warping coefficient is used at the coder sampling rate of 8 kHz. The approach has been developed further to include a CELP coding core for representing the excitation signal in [KTK95], again using a fixed value of 0.31 for the warping coefficient at the coder sampling rate of 8 kHz.

Even though the authors claim good performance of the proposed scheme, state-of-the-art speech coding did not adopt the warped predictive coding techniques.

Other combinations of warped LPC and CELP coding are known, e.g. [HLM99] for which a warping factor of 0.723 is used at a sampling rate of 44.1 kHz.

[TMK94] K. Tokuda, H. Matsumura, T. Kobayashi and S. Imai, "Speech coding based on adaptive mel-cepstral analysis," Proc. IEEE ICASSP'94, pp. 197-200, Apr. 1994.

[KTK95] K. Koishida, K. Tokuda, T. Kobayashi and S. Imai, "CELP coding based on mel-cepstral analysis," Proc. IEEE ICASSP'95, pp. 33-36, 1395.

[HLM99] Aki Härmä, Unto K. Laine, Matti Karjalainen, "Warped low-delay CELP for wideband audio coding", 17th International AES Conference, Florence, Italy, 1999

[VM06] Peter Vary, Rainer Martin, "Digital Speech Transmission: Enhancement, Coding and Error Concealment", published by John Wiley & Sons, LTD, 2006, ISBN 0-471-56018-9

Generalized Warped LPC Coding

The idea of performing speech coding on a warped frequency scale was developed further over the following years. Specifically, it was noticed that a full conventional warping of the spectral analysis according to a perceptual frequency scale may not be appropriate to achieve best possible quality for coding speech signals. Therefore, a Mel-generalized cepstral analysis was proposed in [KTK96] which allows to fade the characteristics of the spectral model between that of the previously proposed mel-cepstral analysis (with a fully warped frequency scale and a cepstral analysis), and the characteristics of a traditional LPC model (with a uniform frequency scale and an all-pole model of the signal's spectral envelope). Specifically, the proposed generalized analysis has two parameters that control these characteristics:

The parameter $\gamma$, $-1 \leqq \gamma \leqq 0$ continuously fades between a cepstral-type and an LPC-type of analysis, where $\gamma=0$ corresponds to a cepstral-type analysis and $\gamma=-1$ corresponds to an LPC-type analysis.

The parameter $\alpha$, $|\alpha|<1$ is the warping factor. A value of $\alpha=0$ corresponds to a fully uniform frequency scale (like in standard LPC), and a value of $\alpha=0.31$ corresponds to a full perceptual frequency warping.

The same concept was applied to coding of wideband speech (at a sampling rate of 16 kHz) in [KHT98]. It should be noted that the operating point ($\gamma$; $\alpha$) for such a generalized analysis is chosen a priori and not varied over time.

[KTK96] K. Koishida, K. Tokuda, T. Kobayashi and S. Imai, "CELP coding system based on mel-generalized cepstral analysis," Proc. ICSLP'96, pp. 318-321, 1996.

[KHT98] K. Koishida, G. Hirabayashi, K. Tokuda, and T. Kobayashi, "A wideband CELP speech coder at 16 kbit/s based on mel-generalized cepstral analysis," Proc. IEEE ICASSP'98, pp. 161-164, 1998.

A structure comprising both an encoding filter and two alternate coding kernels has been described previously in the literature ("WB-AMR+ Coder" [BLS05]). There does not exist any notion of using a warped filter, or even a filter with time-varying warping characteristics.

[BLS05] B. Bessette, R. Lefebvre, R. Salami, "UNIVERSAL SPEECH/AUDIO CODING USING HYBRID ACELP/TCX TECHNIQUES," Proc. IEEE ICASSP 2005, pp. 301-304, 2005.

The disadvantage of all those prior art techniques is that they all are dedicated to a specific audio coding algorithm. Any speech coder using warping filters is optimally adapted for speech signals, but commits compromises when it comes to encoding of general audio signals such as music signals.

On the other hand, general audio coders are optimized to perfectly hide the quantization noise below the masking threshold, i.e., are optimally adapted to perform an irrelevance reduction. To this end, they have a functionality for accounting for the non-uniform frequency resolution of the human hearing mechanism. However, due to the fact that they are general audio encoders, they cannot specifically make use of any a-priori knowledge on a specific kind of signal patterns which are the reason for obtaining the very low bitrates known from e.g. speech coders.

Furthermore, many speech coders are time-domain encoders using fixed and variable codebooks, while most general audio coders are, due to the masking threshold issue, which is a frequency measure, filterbank-based encoders so that it is highly problematic to introduce both coders into a single encoding/decoding frame in an efficient manner, although there also exist time-domain based general audio encoders.

SUMMARY OF THE INVENTION

It is the object of the present invention to provide an improved general purpose coding concept providing high quality and low bitrate not only for specific signal patterns but even for general audio signals.

In accordance with the first aspect of the present invention, this object is achieved by an audio encoder for encoding an audio signal, comprising a pre-filter for generating a pre-filtered audio signal, the pre-filter having a variable warping characteristic, the warping characteristic being controllable in response to a time-varying control signal, the control signal indicating a small or no warping characteristic or a comparatively high warping characteristic; a controller for providing the time-varying control signal, the time-varying control signal depending on the audio signal; and a controllable encoding processor for processing the pre-filtered audio signal to obtain an encoded audio signal, wherein the encoding processor is adapted to process the pre-filtered audio signal in accordance with a first coding algorithm adapted to a specific signal pattern, or in accordance with a second different encoding algorithm suitable for encoding a general audio signal.

Preferably, the encoding processor is adapted to be controlled by the controller so that an audio signal portion being filtered using the comparatively high warping characteristic is processed using the second encoding algorithm to obtain the encoded signal and an audio signal being filtered using the small or no warping characteristic is processed using the first encoding algorithm.

In accordance with a further aspect of the present invention, this object is achieved by an audio decoder for decoding an encoded audio signal, the encoded audio signal having a first portion encoded in accordance with a first coding algorithm adapted to a specific signal pattern, and having a second portion encoded in accordance with a different second coding algorithm suitable for encoding a general audio signal, comprising: a detector for detecting a coding algorithm underlying the first portion or the second portion; a decoding processor for decoding, in response to the detector, the first portion using the first coding algorithm to obtain a first decoded time portion and for decoding the second portion using the second coding algorithm to obtain a second decoded time portion; and a post-filter having a variable warping characteristic being controllable between a first state having a small or no warping characteristic and a second state having a comparatively high warping characteristic.

Preferably, the post-filter is controlled such that the first decoded time portion is filtered using the small or no warping characteristic and the second decoded time portion is filtered using a comparatively high warping characteristic.

In accordance with a further aspect of the present invention, this object is achieved by an audio processor for processing an audio signal, comprising: a filter for generating a filtered audio signal, the filter having a variable warping characteristic, the warping characteristic being controllable in response to a time-varying control signal, the control signal indicating a small or no warping characteristic or a comparatively high warping characteristic; and a controller for providing the time-varying control signal, the time-varying control signal depending on the audio signal.

Further aspects of the present invention relate to corresponding methods of encoding, decoding and audio processing as well as associated computer programs and the encoded audio signal.

The present invention is based on the finding that a pre-filter having a variable warping characteristic on the audio encoder side is the key feature for integrating different coding algorithms to a single encoder frame. These two different coding algorithms are different from each other. The first coding algorithm is adapted to a specific signal pattern such as speech signals, but also any other specifically harmonic patterns, pitched patterns or transient patterns are an option, while the second coding algorithm is suitable for encoding a general audio signal. The pre-filter on the encoder-side or the post-filter on the de-coder-side make it possible to integrate the signal specific coding module and the general coding module within a single encoder/decoder framework.

Generally, the input for the general audio encoder module or the signal specific encoder module can be warped to a higher or lower or no degree. This depends on the specific signal and the implementation of the encoder modules. Thus, the interrelation of which warp filter characteristic belongs to which coding module can be signaled. In several cases the result might be that the stronger warping characteristic belongs to the general audio coder and the lighter or no warping characteristic belongs to the signal specific module. This situation can—in some embodiments—fixedly set or can be the result of dynamically signaling the encoder module for a certain signal portion.

While the coding algorithm adapted for specific signal patterns normally does not heavily rely on using the masking threshold for irrelevance reduction, this coding algorithm does not necessarily need any warping pre-processing or only a "soft" warping pre-processing. This means that the first coding algorithm adapted for a specific signal pattern advantageously uses a-priori knowledge on the specific signal pattern but does not rely that much on the masking threshold and, therefore, does not need to approach the non-uniform frequency resolution of the human listening mechanism. The non-uniform frequency resolution of the human listening mechanism is reflected by scale factor bands having different bandwidths along the frequency scale. This non-uniform frequency scale is also known as the BARK or ERR scale.

Processing and noise shaping using a non-uniform frequency resolution is only necessary, when the coding algorithm heavily relies on irrelevance reduction by utilizing the concept of a masking threshold, but is not required for a specific coding algorithm which is adapted to a specific signal pattern and uses a-priori knowledge to highly efficiently process such a specific signal pattern. In fact, any non-uniform frequency warping processing might be harmful for the efficiency of such a specific signal pattern adapted coding algorithm, since such warping will influence the specific signal pattern which, due to the fact that the first coding algorithm is heavily optimized for a specific signal pattern, may strongly degrade coding efficiency of the first coding algorithm.

Contrary thereto, the second coding algorithm can only produce an acceptable output bitrate together with an acceptable audio quality, when any measure is taken which accounts for the non-uniform frequency resolution of the human listening mechanism so that optimum benefit can be drawn from the masking threshold.

Since the audio signal may include specific signal patterns followed by general audio, i.e., a signal not having this specific signal pattern or only having this specific signal pattern to a small extent, the inventive pre-filter only warps to a strong degree, when there is a signal portion not having the specific signal pattern, while for a signal not having the specific signal pattern, no warping at all or only a small warping characteristic is applied.

Particularly for the case, where the first coding algorithm is any coding algorithm relying on linear predictive coding, and where the second coding algorithm is a general audio coder based on a per-filter/post-filter architecture, the pre-filter can perform different tasks using the same filter. When the audio signal has the specific signal pattern, the pre-filter works as an LPC analysis filter so that the first encoding algorithm is only related to the encoding of the residual signal or the LPC excitation signal.

When there is a signal portion which does not have the specific signal pattern, the pre-filter is controlled to have a strong warping characteristic and, preferably, to perform LPC filtering based on the psycho-acoustic masking threshold so that the pre-filtered output signal is filtered by the frequency-warped filter and is such that psychoacoustically more important spectral portions are amplified with respect to psychoacoustically less important spectral portions. Then, a straightforward quantizer can be used, or, generally stated, quantization during encoding can take place without having to distribute the coding noise non-uniformly over the frequency range in the output of the warped filter. The noise shaping of the quantization noise will automatically take place by the post-filtering action obtained by the time-varying warped filter on the decoder-side, which is—with respect to the warping characteristic—identical to the encoder-side pre-filter and, due to the fact that this filter is inverse to the pre-filter on the decoder side, automatically produces the noise shaping to obtain a maximum irrelevance reduction while maintaining a high audio quality.

BRIEF DESCRIPTION OF THE DRAWINGS

Preferred embodiments of the present invention are subsequently explained with reference to the accompanying Figures, in which.

DETAILED DESCRIPTION OF PREFERRED EMBODIMENTS

Figure 1:
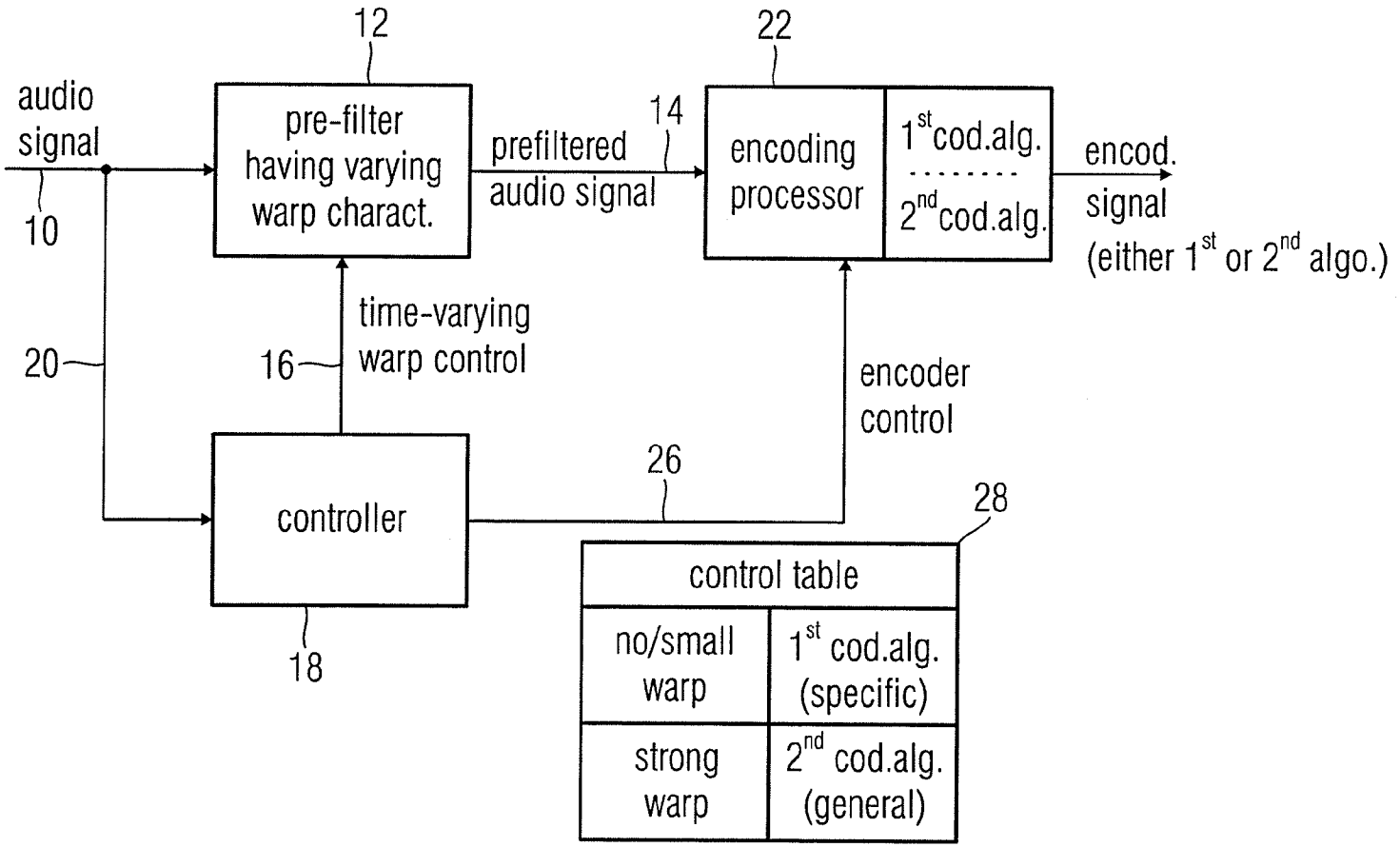
FIG. 1 is a block diagram of a preferred audio encoder.

Preferred embodiments of the present invention provide a uniform method that allows coding of both general audio signals and speech signals with a coding performance that—at least—matches the performance of the best known coding schemes for both types of signals. It is based on the following considerations:

For coding of general audio signals, it is essential to shape the coding noise spectral envelope according to a masking threshold curve (according to the idea of "perceptual audio coding"), and thus a perceptually warped frequency scale is desirable. Nonetheless, there may be certain (e.g. harmonic) audio signals where a uniform frequency resolution would perform better that a perceptually warped one because the former can better resolve their individual spectral fine structure.

For the coding of speech signals, the state of the art coding performance can be achieved by means of regular (non-warped) linear prediction. There may be certain speech signals for which some amount of warping improves the coding performance.

In accordance with the inventive idea, this dilemma is solved by a coding system that includes an encoder filter that can smoothly fade in its characteristics between a fully warped operation, as it is generally preferable for coding of music signals, and a non-warped operation, as it is generally preferable for coding of speech signals. Specifically, the proposed inventive approach includes a linear filter with a time-varying warping factor. This filter is controlled by an extra input that receives the desired warping factor and modifies the filter operation accordingly.

An operation of such a filter permits the filter to act both as a model of the masking curve (post-filter for coding of music, with warping on, $\lambda=\lambda_0$), and as a model of the signal's spectral envelope (Inverse LPC filter for coding of speech, with warping off, $\lambda=0$), depending on the control input. If the inventive filter is equipped to handle also a continuum of intermediate warping factors $0\leqq\lambda\leqq\lambda_0$ then furthermore also soft in-between characteristics are possible.

Naturally, the inverse decoder filtering mechanism is similarly equipped, i.e. a linear decoder filter with a time-varying warping factor and can act as a perceptual pre-filter as well as an LPC filter.

In order to generate a well-behaved filtered signal to be coded subsequently, it is desirable to not switch instantaneously between two different values of the warping factor, but to apply a soft transition of the warping factor over time. As an example, a transition of 128 samples between unwarped and fully perceptually warped operation avoids undesirable discontinuities in the output signal.

Using such a filter with variable warping, it is possible to build a combined speech/audio coder which achieves both optimum speech and audio coding quality in the following way (see FIG. 7 or 8):

- The decision about the coding mode to be used ("Speech mode" or "Music mode") is performed in a separate module by carrying out an analysis of the input signal and can be based on known techniques for discriminating speech signals from music. As a result, the decision module produces a decision about the coding mode/and an associated optimum warping factor for the filter. Furthermore, depending on the this decision, it determines a set of suitable filter coefficients which are appropriate for the input signal at the chosen coding mode, i.e. for coding of speech, an LPC analysis is performed (with no warping, or a low warping factor) whereas for coding of music, a masking curve is estimated and its inverse is converted into warped spectral coefficients.
- The filter with the time varying warping characteristics is used as a common encoder/decoder filter and is applied to the signal depending on the coding mode decision/warping factor and the set of filter coefficients produced by the decision module.
- The output signal of the filtering stage is coded by either a speech coding kernel (e.g. CELP coder) or a generic audio coder kernel (e.g. a filterbank/subband coder, or a predictive audio coder), or both, depending on the coding mode.
- The information to the transmitted/stored comprises the coding mode decision (or an indication of the warping factor), the filter coefficients in some coded form, and the information delivered by the speech/excitation and the generic audio coder.

The corresponding decoder works accordingly: It receives the transmitted information, decodes the speech and generic audio parts according to the coding mode information, combines them into a single intermediate signal (e.g. by adding them), and filters this intermediate signal using the coding mode/warping factor and filter coefficients to form the final output signal.

Subsequently, a preferred embodiment of the inventive audio encoder will be discussed in connection with FIG. 1. The FIG. 1 audio encoder is operative for encoding an audio signal input at line 10. The audio signal is input into a pre-filter 12 for generating a pre-filtered audio signal appearing at line 14. The pre-filter has a variable warping characteristic, the warping characteristic being controllable in response to a time-varying control signal on line 16. The control signal indicates a small or no warping characteristic or a comparatively high warping characteristic. Thus, the time-varying warp control signal can be a signal having two different states such as "1" for a strong warp or a "0" for no warping. The intended goal for applying warping is to obtain a frequency resolution of the pre-filter similar to the BARK scale. However, also different states of the signal/warping characteristic setting are possible.

Furthermore, the inventive audio encoder includes a controller 18 for providing the time-varying control signal, wherein the time varying control signal depends on the audio signal as shown by line 20 in FIG. 1. Furthermore, the inventive audio encoder includes a controllable encoding processor 22 for processing the pre-filtered audio signal to obtain an encoded audio signal output at line 24. Particularly, the encoding processor 22 is adapted to process the pre-filtered audio signal in accordance with a first coding algorithm adapted to a specific signal pattern, or in accordance with a second, different encoding algorithm suitable for encoding a general audio signal. Particularly, the encoding processor 22 is adapted to be controlled by the controller 18 preferably via a separate encoder control signal on line 26 so that an audio signal portion being filtered using the comparatively high warping factor is processed using the second encoding algorithm to obtain the encoded signal for this audio signal portion, so that an audio signal portion being filtered using no or only a small warping characteristic is processed using the first encoding algorithm.

Thus, as it is shown in the control table 28 for the signal on control line 26, in some situations when processing an audio signal, no or only a small warp is performed by the filter for a signal being filtered in accordance with the first coding algorithm, while, when a strong and preferably perceptually full-scale warp is applied by the pre-filter, the time portion is processed using the second coding algorithm for general audio signals, which is preferably based on hiding quantization noise below a psycho-acoustic masking threshold. Naturally, the invention also covers the case that for a further portion of the audio signal, which has the signal-specific pattern, a high warping characteristic is applied while for an even further portion riot having the specific signal pattern, a low or no warping characteristic is used. This can be for example determined by an analysis by synthesis encoder decision or by any other algorithms know in the art. However, the encoder module control can also be fixedly set depending on the transmitted warping factor or the warping factor can be derived from a transmitted coder module indication. Furthermore, both information items can be transmitted as side information, i.e., the coder module and the warping factor.

Figure 2:
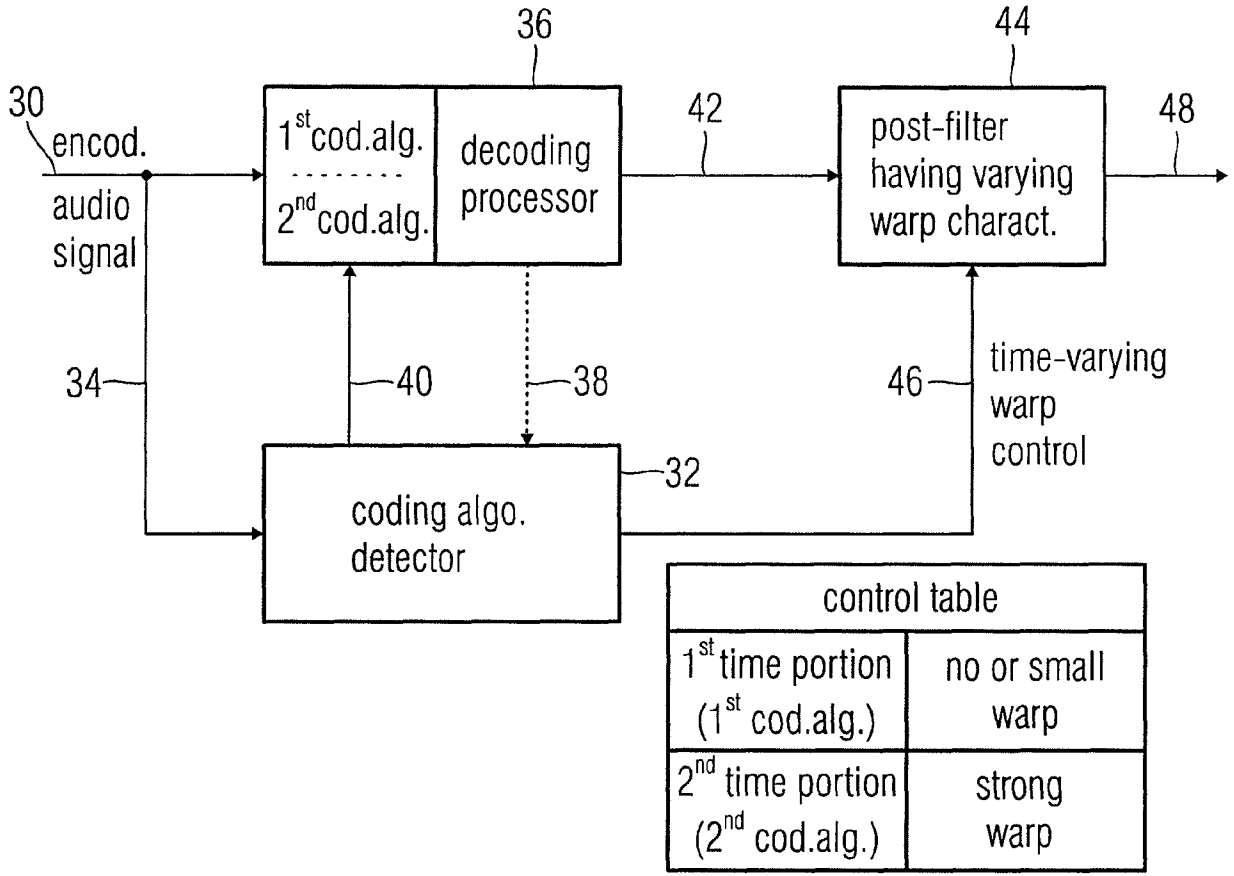
FIG. 2 is a block diagram of a preferred audio decoder.

FIG. 2 illustrates an inventive decoder for decoding an encoded audio signal input at line 30. The encoded audio signal has a first portion encoded in accordance with a first coding algorithm adapted to a specific signal pattern, and has a second portion encoded in accordance with a different second coding algorithm suitable for encoding a general audio signal. Particularly, the inventive decoder comprises a detector 32 for detecting a coding algorithm underlying the first or the second portion. This detection can take place by extracting side information from the encoded audio signal as illustrated by broken line 34, and/or can take place by examining the bit-stream coming into a decoding processor 36 as illustrated by broken line 38. The decoding processor 36 is for decoding in response to the detector as illustrated by control line 40 so that for both the first and second portions the correct coding algorithm is selected.

Preferably, the decoding processor is operative to use the first coding algorithm for decoding the first time portion and to use the second coding algorithm for decoding the second time portion so that the first and the second decoded time portions are output on line 42. Line 42 carries the input into a post-filter 44 having a variable warping characteristic. Particularly, the post-filter 44 is controllable using a time-varying warp control signal on line 46 so that this post-filter has only small or no warping characteristic in a first state and has a high warping characteristic in a second state.

Preferably, the post-filter 44 is controlled such that the first time portion decoded using the first coding algorithm is filtered using the small or no warping characteristic and the second time portion of the decoded audio signal is filtered using the comparatively strong warping characteristic so that an audio decoder output signal is obtained at line 48.

When looking at FIG. 1 and FIG. 2, the first coding algorithm determines the encoder-related steps to be taken in the encoding processor 22 and the corresponding decoder-related steps to be implemented in decoding processor 36. Furthermore, the second coding algorithm determines the encoder-related second coding algorithm steps to be used in the encoding processor and corresponding second coding algorithm-related decoding steps to be used in decoding processor 36.

Furthermore, the pre-filter 12 and the post-filter 44 are, in general, inverse to each other. The warping characteristics of those filters are controlled such that the post-filter has the same warping characteristic as the pre-filter or at least a similar warping characteristic within a 10 percent tolerance range.

Naturally, when the pre-filter is not warped due to the fact that there is e.g. a signal having the specific signal pattern, then the post-filter also does not have to be a warped filter.

Nevertheless, the pre-filter 12 as well as the post-filter 44 can implement any other pre-filter or post-filter operations required in connection with the first coding algorithm or the second coding algorithm as will be outlined later on.

Figure 3A:
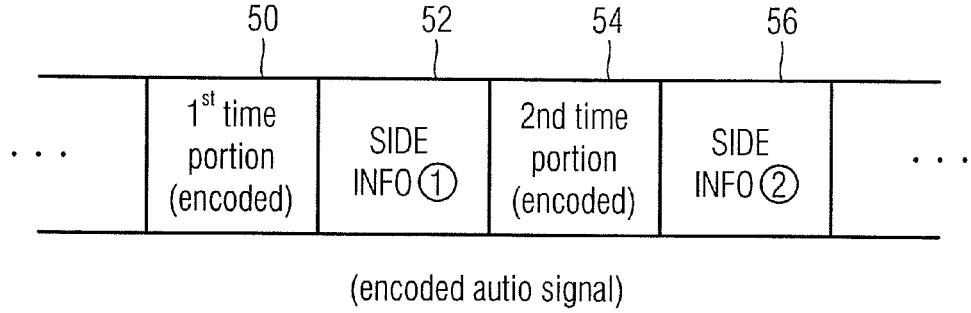
FIG. 3*a* is a schematic representation of the encoded audio signal.

FIG. 3*a* illustrates an example of an encoded audio signal as obtained on line 24 of FIG. 1 and as can be found on line 30 of FIG. 2. Particularly, the encoded audio signal includes a first time portion in encoded form, which has been generated by the first coding algorithm as outlined at 50 and corresponding side information 52 for the first portion. Furthermore, the bit-stream includes a second time portion in encoded form as shown at 54 and side information 56 for the second time portion. It is to be noted here that the order of the items in FIG. 3*a* may vary. Furthermore, the side information does not necessarily have to be multiplexed between the main information 50 and 54. Those signals can even come from separate sources as dictated by external requirements or implementations.

Figure 3B:
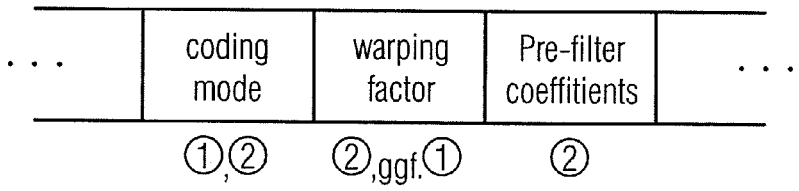
FIG. 3*b* is a schematic representation of the side information for the first and/or the second time portion of FIG. 3*a;*

FIG. 3*b* illustrates side information for the explicit signaling embodiment of the present invention for explicitly signaling the warping factor and encoder mode, which can be used in 52 and 56 of FIG. 3*a*. This is indicated below the FIG. 3*b* side information stream. Hence, the side information may include a coding mode indication explicitly signaling the first or the second coding algorithm underlying this portion to which the side information belongs to.

Furthermore, a warping factor can be signaled. Signaling of the warping factor is not necessary, when the whole system can only use two different warping characteristics, i.e., no warping characteristic as the first possibility and a perceptually full-scale warping characteristic as the second possibility. In this case, a warping factor can be fixed and does not necessarily have to be transmitted.

Nevertheless, in preferred embodiments, the warping factor can have more than these two extreme values so that an explicit signaling of the warping factor such as by absolute values or differentially coded values is used.

Furthermore, it is preferred that the pre-filter not only implements is warped but also implements tasks dictated by the first coding algorithm and the second coding algorithm, which leads to a more efficient functionality of the first and the second coding algorithms.

When the first coding algorithm is an LPC-based coding algorithm, then the pre-filter also performs the functionality of the LPC analysis filter and the post-filter on the decoder-side performs the functionality of an LPC synthesis filter.

When the second coding algorithm is a general audio encoder not having a specific noise shaping functionality, the pre-filter is preferably an LPC filter, which pre-filters the audio signal so that, after pre-filtering, psychoacoustically more important portions are amplified with respect to psychoacoustically less important portions. On the decoder-side, the post-filter is implemented as a filter for regenerating a situation similar to a situation before pre-filtering, i.e. an inverse filter which amplifies less important portions with respect to more important portions so that the signal after post-filtering is—apart from coding errors—similar to the original audio signal input into the encoder.

The filter coefficients for the above described pre-filter are preferably also transmitted via side information from the encoder to the decoder.

Figure 4:
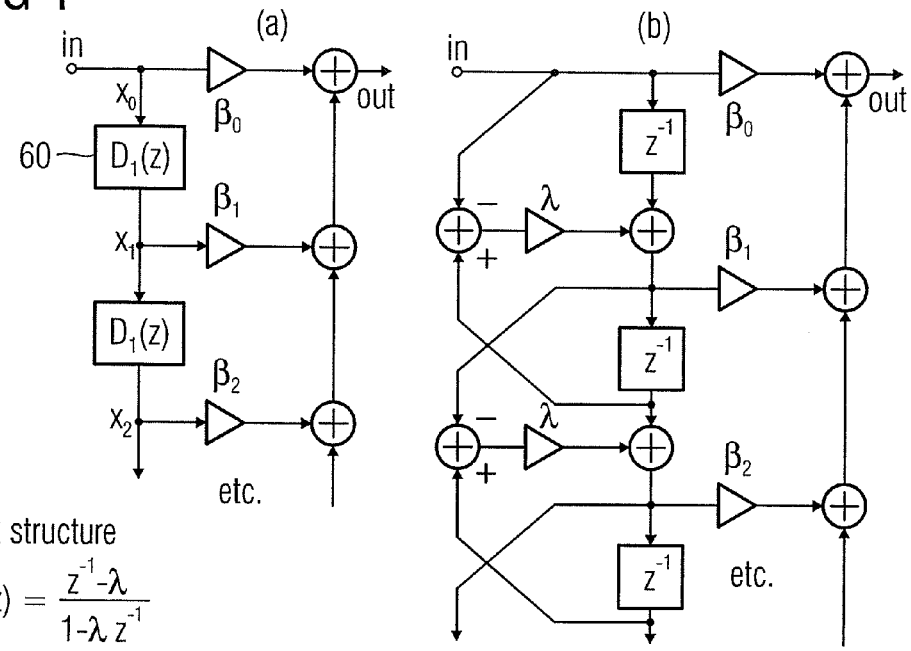
FIG. 4 is a representation of a prior art FIR pre-filter or post-filter, which is suitable for use in the present invention.

Typically, the pre-filter as well as the post-filter will be implemented as a warped FIR filter, a structure of which is illustrated in FIG. 4, or as a warped IIR digital filter. The FIG. 4 filter is described in detail in [KHL 97]. Examples for warped IIR filters are also shown in [KHL 97]. All those digital filters have in common that they have warped delay elements 60 and weighting coefficients or weighting elements indicated by $\beta_0$, $\beta_1$, $\beta_2$, . . . . A filter structure is transformed to a warped filter, when a delay element in an unwarped filter structure (not shown here) is replaced by an all-pass filter, such as a first-order allpass filter D(z), as illustrated in on both sides of the filter structures in FIG. 4. A computationally efficient implementation of the left structure is shown in the right of FIG. 4, where the explicit usage of the warping factor $\lambda$ and the implementation thereof is shown.

Thus, the filter structure to the right of FIG. 4 can easily be implemented within the pre-filter as well as within the post-filter, wherein the warping factor is controlled by the parameter $\lambda$, while the filter characteristic, i.e., the filter coefficients of the LPC analysis/synthesis or pre-filtering or post-filtering for amplifying/damping psycho-acoustically more important portions is controlled by setting the weighting parameters $\beta_0$, $\beta_1$, $\beta_2$, . . . to appropriate values.

Figure 5:
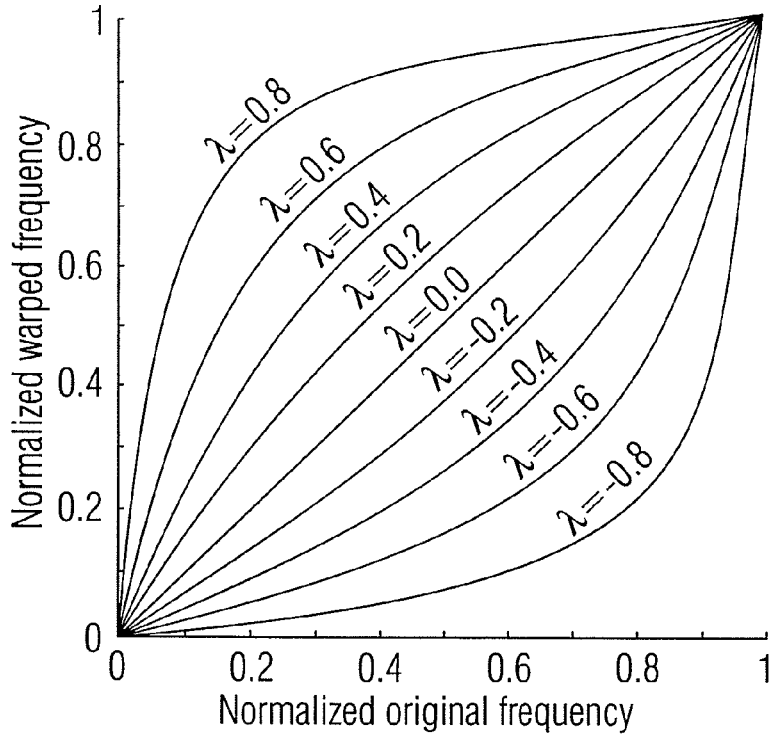
FIG. 5 illustrates the warping characteristic of a filter dependent on the warping factor.

FIG. 5 illustrates the dependence of the frequency-warping characteristic on the warping factor $\lambda$ for $\lambda$s between −0.8 and +0.8. No warping at all will be obtained, when $\lambda$ is set to 0.0. A psycho-acoustically full-scale warp is obtained by setting $\lambda$ between 0.3 and 0.4. Generally, the optimum warping factor depends on the chosen sampling rate and has a value of between about 0.3 and 0.4 for sampling rates between 32 and 48 kHz. The then obtained non-uniform frequency resolution by using the warped filter is similar to the BARK or ERB scale. Substantially stronger warping characteristics can be implemented, but those are only useful in certain situations, which can happen when the controller determines that those higher warping factors are useful.

Figure 6:
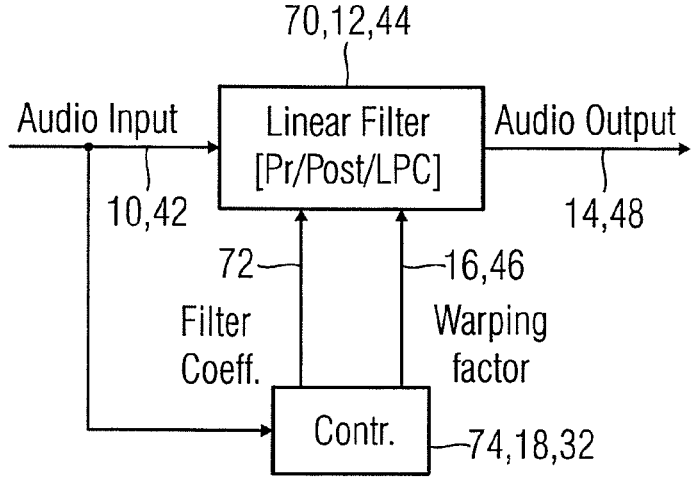
(prior art) FIG 6
FIG. 6 illustrates an inventive audio processor having a linear filter having a time-varying warping characteristic and a controller.

Thus, the pre-filter on the encoder-side will preferably have positive warping factors λ to increase the frequency resolution in the low frequency range and to decrease the frequency resolution in the high frequency range. Hence, the post-filter on the decoder-side will also have the positive warping factors. Thus, a preferred inventive time-varying warping filter is shown in FIG. 6 at 70 as a part of the audio processor. The inventive filter is, preferably, a linear filter, which is implemented as a pre-filter or a post-filter for filtering to amplify or damp psycho-acoustically more/less important portions or which is implemented as an LPC analysis/synthesis filter depending on the control signal of the system. It is to note at this point that the warped filter is a linear filter and does not change the frequency of a component such as a sine wave input into the filter. However, when it is assumed that the filter before warping is a low pass filter, the FIG. 5 diagram has to be interpreted as set out below.

When the example sine wave has a normalized original frequency of 0.6, then the filter would apply—for a warping factor equal to 0.0—the phase and amplitude weighting defined by the filter impulse response of this unwarped filter.

When a warping factor of 0.8 is set for this lowpass filter (now the filter becomes a warped filter), the sine wave having a normalized frequency of 0.6 will be filtered such that the output is weighted by the phase and amplitude weighting which the unwarped filter has for a normalized frequency of 0.97 in FIG. 5. Since this filter is a linear filter, the frequency of the sine wave is not changed.

Depending on the situation, when the filter 70 is only warped, then a warping factor or, generally, the warping control 16; or 46, has to be applied. The filter coefficients $\beta_i$ are derived from the masking threshold. These filter coefficients can be pre- or post-filter coefficients, or LPC analysis/synthesis filter coefficients, or any other filter coefficients useful in connection with any first or second coding algorithms.

Thus, an audio processor in accordance with the present invention includes, in addition to the filter having variable warping characteristics, the controller 18 of FIG. 1 or the controller implemented as the coding algorithm detector 32 of FIG. 2 or a general audio input signal analyzer looking for a specific signal pattern in the audio input 10/42 so that a certain warping characteristic can be set, which fits to the specific signal pattern so that a time-adapted variable warping of the audio input be it an encoded or a decoded audio input can be obtained. Preferably, the pre-filter coefficients and the post-filter coefficients are identical.

The output of the audio processor illustrated in FIG. 6 which consists of the filter 70 and the controller 74 can then be stored for any purposes or can be processed by encoding processor 22, or by an audio reproduction device when the audio processor is on the decoder-side, or can be processed by any other signal processing algorithms.

Figure 7:
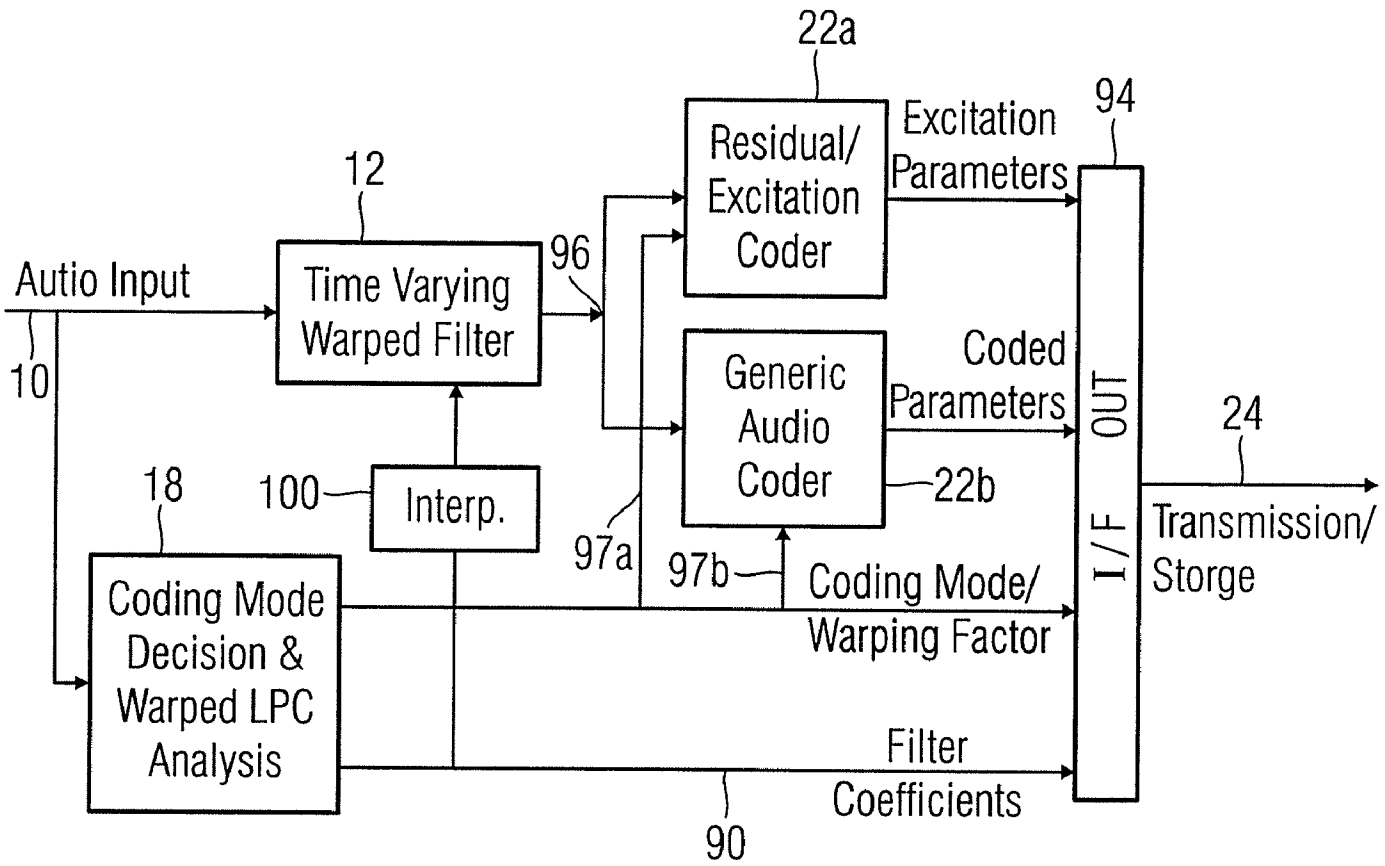
FIG. 7 illustrates a preferred embodiment of the inventive audio encoder.
Figure 8:
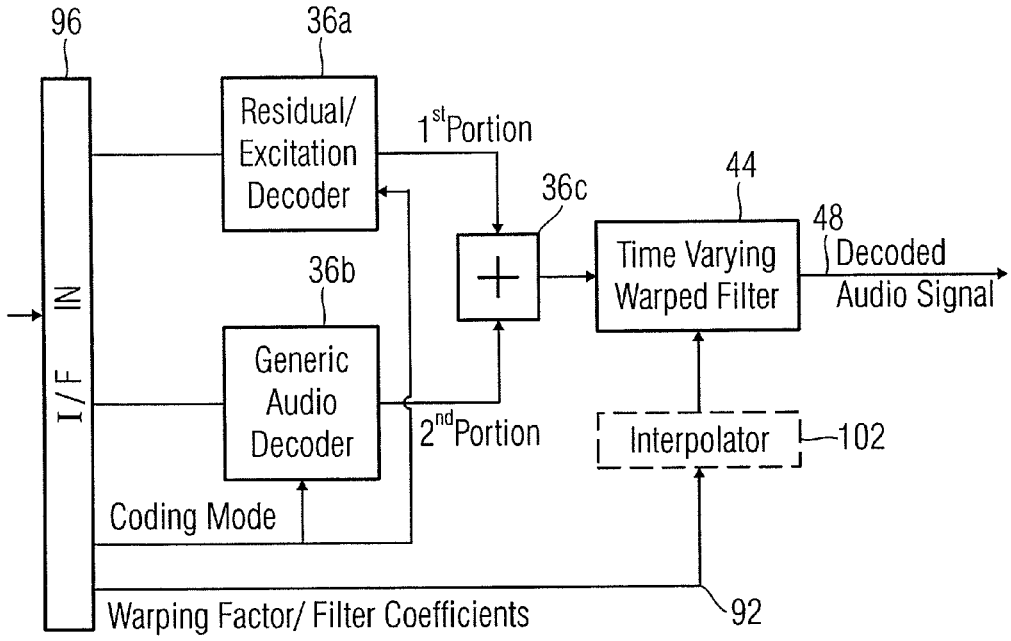
FIG. 8 illustrates a preferred embodiment for an inventive audio decoder.
Figure 9:
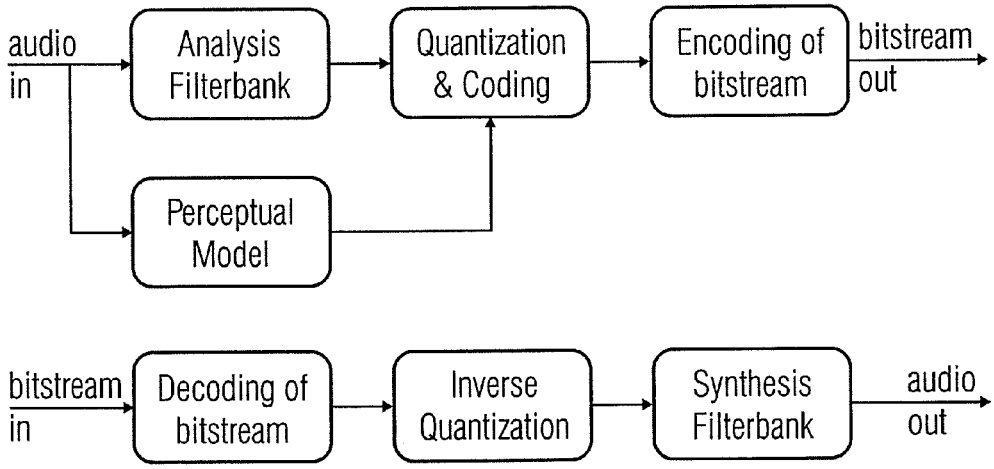
FIG. 9 illustrates a prior art filterbank-based coding algorithm having an encoder and a decoder.
Figure 10:
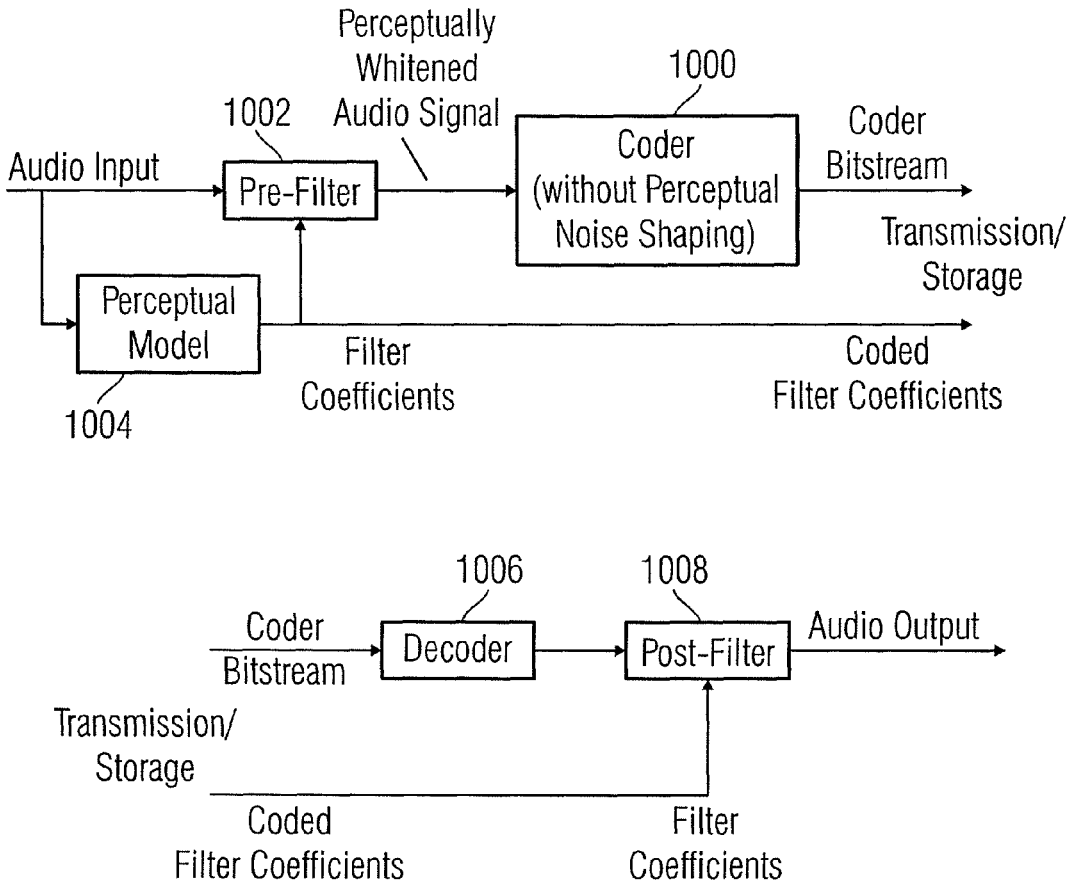
FIG. 10 illustrates a prior art pre/post-filter based audio encoding algorithm having an encoder and a decoder.

Subsequently, FIGS. 7 and 8 will be discussed, which show preferred embodiments of the inventive encoder (FIG. 7) and the inventive decoder (FIG. 8). The functionalities of the devices are similar to the FIG. 1, FIG. 2 devices. Particularly, FIG. 7 illustrates the embodiment, wherein the first coding algorithm is a speech-coder like coding algorithm, wherein the specific signal pattern is a speech pattern in the audio input 10. The second coding algorithm 22*b* is a generic audio coder such as the straightforward filterbank-based audio coder as illustrated and discussed in connection with FIG. 9, or the pre-filter/post-filter audio coding algorithm as illustrated in FIG. 10.

Figure 11:
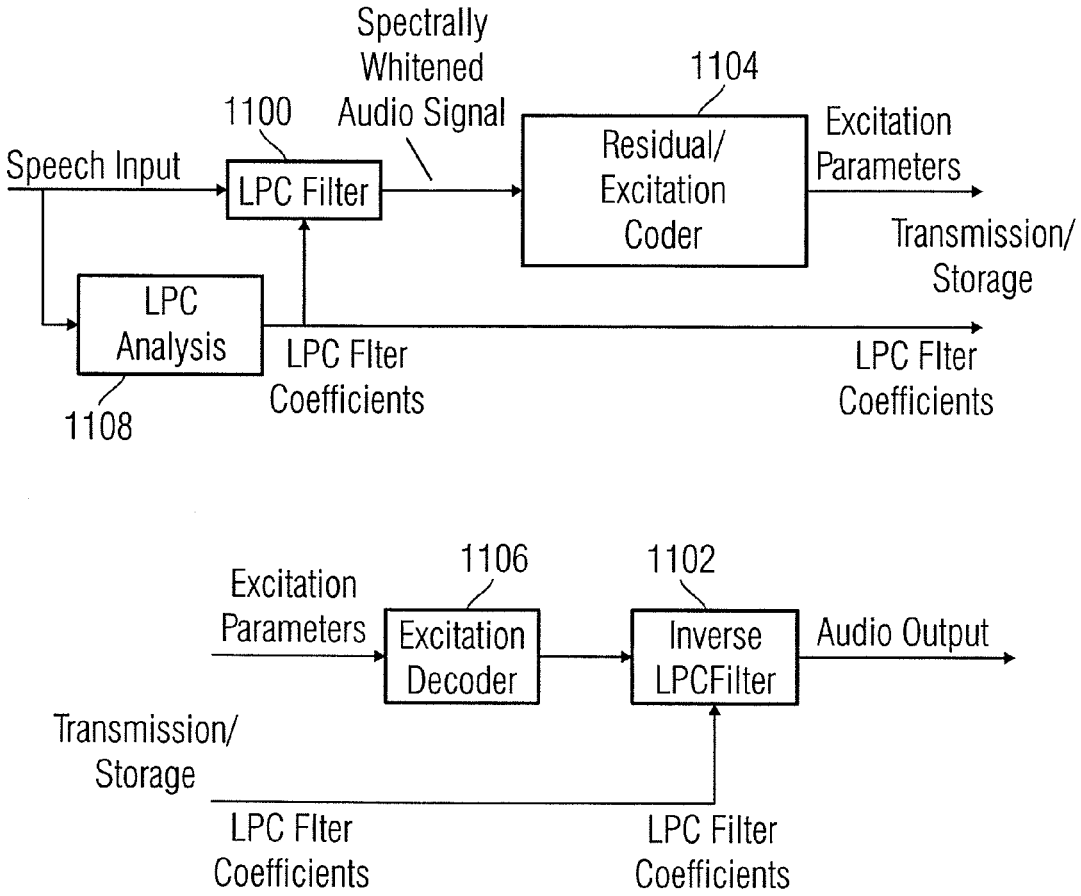
FIG. 11 illustrates a prior art LPC coding algorithm having an encoder and a decoder.

The first coding algorithm corresponds to the FIG. 11 speech coding system, which, in addition to an LPC analysis/synthesis filter 1100 and 1102 also includes a residual/excitation coder 1104 and a corresponding excitation decoder 1106. In this embodiment, the time-varying warped filter 12 in FIG. 7 has the same functionality as the LPC filter 1100, and the LPC analysis implemented in block 1108 in FIG. 11 is implemented in controller 18.

The residual/excitation coder 1104 corresponds to the residual/excitation coder kernel 22*a* in FIG. 7. Similarly, the excitation decoder 1106 corresponds to the residual/excitation decoder 36*a* in FIG. 8, and the time-varying warped filter 44 has the functionality of the inverse LPC filter 1102 for a first time portion being coded in accordance with the first coding algorithm.

The LPC filter coefficients generated by LPC analysis block 1108 correspond to the filter coefficients shown at 90 in FIG. 7 for the first time portion and the LPC filter coefficients input into block 1102 in FIG. 11 correspond to the filter coefficients on line 92 of FIG. 8. Furthermore, the FIG. 7 encoder includes an encoder output interface 94, which can be implemented as a bit-stream multiplexer, but which can also be implemented as any other device producing a data stream suitable for transmission and/or storage. Correspondingly, the FIG. 8 decoder includes an input interface 96, which can be implemented as a bit-stream demultiplexer for demultiplexing the specific time portion information as discussed in connection with FIG. 3*a* and for also extracting the required side-information as illustrated in FIG. 3*b*.

In the FIG. 7 embodiment, both encoding kernels 22*a*, 22*b*, have a common input 96, and are controlled by the controller 18 via lines 97*a* and 97*b*. This control makes sure that, at a certain time instant, only one of both encoder kernels 22*a*, 22*b* outputs main and side information to the output interface. Alternatively, both encoding kernels could work fully parallel, and the encoder controller 18 would make sure that only the output of the encoding kernel is input into the bit-stream, which is indicated by the coding mode information while the output of the other encoder is discarded.

Again alternatively, both decoders can operate in parallel and outputs thereof can be added. In this situation, it is preferred to use a medium warping characteristic for the encoder-side pre-filter and for the decoder-side post-filter. Furthermore, this embodiment processes e.g. a speech portion of a signal such as a certain frequency range or—generally—signal portion by the first coding algorithm and the remainder of the signal by the second general coding algorithm. Then outputs of both coders are transmitted from the encoder to the decoder side. The decoder-side combination makes sure that the signal is rejoined before being post-filtered.

Any kind of specific controls can be implemented as long as they make sure that the output encoded audio signal 24 has a sequence of first and second portions as illustrated in FIG. 3 or a correct combination of signal portions such as a speech portion and a general audio portion.

On the decoder-side, the coding mode information is used for decoding the time portion using the correct decoding algorithm so that a time-staggered pattern of first portions and second portions obtain at the outputs of decoder kernels 36*a*, and 36*b*, which are, then, multiplexed into a single time domain signal, which is illustrated schematically using the adder symbol 36*c*. Then, at the output of element 36*c*, there is a time-domain audio signal, which only has to be post-filtered so that the decoded audio signal is obtained.

As discussed earlier in the summary after the Brief Description of the Drawings section, both the encoder in FIG.

7 as well as the decoder in FIG. 8 may include an interpolator 100 or 102 so that a smooth transition via a certain time portion, which at least includes two samples, but which preferably includes more than 50 samples and even more than 100 samples, is implementable. This makes sure that coding artifacts are avoided, which might be caused by rapid changes of the warping factor and the filter coefficients. Since, however, the post-filter as well as the pre-filter fully operate in the time domain, there are no problems related to block-based specific implementations. Thus, one can change, when FIG. 4 is again considered, the values for $\beta_0, \beta_1, \beta_2, \ldots$ and $\lambda$ from sample to sample so that a fade over from a, for example, fully warped state to another state having no warp at all is possible. Although one could transmit interpolated parameters, which would save the interpolator on the decoder-side, it is preferred to not transmit the interpolated values but to transmit the values before interpolation since less side-information bits are required for the latter option.

Furthermore, as already indicated above, the generic audio coder kernel 22*b* as illustrated in FIG. 7 may be identical to the coder 1000 in FIG. 10. In this context, the pre-filter 12 will also perform the functionality of the pre-filter 1002 in FIG. 10. The perceptual model 1004 in FIG. 10 will then be implemented within controller 18 of FIG. 7. The filter coefficients generated by the perceptual model 1004 correspond to the filter coefficients on line 90 in FIG. 7 for a time portion, for which the second coding algorithm is on.

Analogously, the decoder 100G in FIG. 10 is implemented by the generic audio decoder kernel 36*b* in FIG. 8, and the post-filter 1008 is implemented by the time-varying warped filter 44 in FIG. 8. The preferably coded filter coefficients generated by the perceptual model are received, on the decoder-side, on line 92, so that a line titled "filter coefficients" entering post-filter 1008 in FIG. 10 corresponds to line 92 in FIG. 8 for the second coding algorithm time portion.

However, compared to two parallel working encoders in accordance with FIGS. 10 and 11, which are both not perfect due to audio quality and bit rate, the inventive encoder devices and the inventive decoder devices only use a single, but controllable filter and perform a discrimination on the input audio signal to find out whether the time portion of the audio signal has the specific pattern or is just a general audio signal.

Regarding the audio analyzer within controller 18, a variety of different implementations can be used for determining, whether a portion of an audio signal is a portion having the specific signal pattern or whether this portion does not have this specific signal pattern, and, therefore, has to be processed using the general audio encoding algorithm. Although preferred embodiments have been discussed, wherein the specific signal pattern is a speech signal, other signal-specific patterns can be determined and can be encoded using such signal-specific first encoding algorithms such as encoding algorithm for harmonic signals, for noise signals, for tonal signals, for pulse-train-like Signals, etc.

Straightforward detectors are analysis by synthesis detectors, which, for example, try different encoding algorithms, together with different warping detectors to find out the best warping factor together with the best filter coefficients and the best coding algorithm. Such analysis by synthesis detectors are in some cases quite computationally expensive. This does not matter in a situation, wherein there is a small number of encoders and a high number of decoders, since the decoder can be very simple in that case. This is due to the fact that only the encoder performs this complex computational task, while the decoder can simply use the transmitted side-information.

Other signal detectors are based on straightforward pattern analyzing algorithms, which look for a specific signal pattern within the audio signal and signal a positive result, when a matching degree exceeds a certain threshold. More information on such detectors is given in [BLS05].

"Moreover, depending on certain implementation requirements of the inventive methods, the inventive methods can be implemented in hardware or using a digital storage medium, in particular a disk or a CD having electronically readable control signals stored thereon, which can cooperate with a programmable computer system such that the inventive methods are performed. Generally, the present invention is, therefore, a computer program product with a program code stored on a machine-readable carrier, the program code being configured for performing at least one of the inventive methods, when the computer program products runs on a computer. In other words, the inventive methods are, therefore, a computer program having a program code for performing the inventive methods, when the computer program runs on a computer."

The above-described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

What is claimed is:

1. Audio encoder for encoding an audio signal, comprising:

a pre-filter for generating a pre-filtered audio signal, the pre-filter having a variable warping characteristic, the warping characteristic being controllable in response to a time-varying control signal, the control signal indicating a small or no warping characteristic or a comparatively high warping characteristic;

a controller for providing the time-varying control signal, the time-varying control signal depending on the audio signal; and a controllable encoding processor for processing the pre-filtered audio signal to obtain an encoded audio signal, wherein the encoding processor is adapted to process the pre-filtered audio signal in accordance with a first coding algorithm adapted to a specific signal pattern, or in accordance with a second different encoding algorithm suitable for encoding a general audio signal.

2. Audio encoder of claim 1, wherein the encoding processor is adapted to use at least a part of a speech-coding algorithm as the first encoding algorithm.

3. Audio encoder of claim 1, wherein the encoding processor is adapted to use a residual/excitation encoding algorithm as a portion of the first coding algorithm, the residual/excitation encoding algorithm including a code-excited linear predictive (CELP) coding algorithm, a multi-pulse excitation (MPE) coding algorithm, or a regular pulse excitation (RPE) coding algorithm.

4. Audio encoder in accordance with claim 1, wherein the encoding processor is adapted to use a filter bank based, filterbank-based, or time-domain based encoding algorithm as the second coding algorithm.

5. Audio encoder of claim 1, further comprising a psychoacoustic module for providing information on a masking threshold, and wherein the pre-filter is operative to perform a filter operation based on the masking threshold so that the in the pre-filtered audio signal, psychoacoustically more important portions are amplified with respect to psychoacoustically less important portions.

6. Audio encoder of claim 5, wherein the pre-filter is a linear filter having a controllable warping factor, the controllable warping factor being determined by the time-varying control signal, and wherein filter coefficients are determined by an analysis based on the masking threshold.

7. Audio encoder of claim 6, further comprising an output stage for outputting information on the masking threshold as side information to the encoded audio signal.

8. Audio encoder of claim 6, wherein the encoding processor is, when applying the second coding algorithm, operative to quantize the pre-filtered audio signal using a quantizer having a quantization characteristic introducing a quantization noise having a flat spectral distribution.

9. Audio encoder of claim 8, wherein the encoding processor is, when applying a second coding algorithm, operative to quantize pre-filtered time domain samples, or sub-band samples, frequency coefficients, or residual samples derived from the pre-filtered audio signal.

10. Audio encoder of claim 1, wherein the first coding algorithm includes a residual or excitation coding step and the second coding algorithm includes a general audio coding step.

11. Audio encoder of claim 1, wherein the encoding processor includes:

a first coding kernel for applying the first coding algorithm to the audio signal;

a second coding kernel for applying the second coding algorithm to the audio signal, wherein both coding kernels have a common input connected to an output of the pre-filter, wherein both coding kernels have separate outputs, wherein the audio encoder further comprises an output stage for outputting the encoded signal, and wherein the controller is operative to only connect an output of the coding kernel indicated by the controller to be active for a time portion to the output stage.

12. Audio encoder of claim 1, wherein the encoding processor includes:

a first coding kernel for applying the first coding algorithm to the audio signal;

a second coding kernel for applying the second coding algorithm to the audio signal;

wherein both coding kernels have a common input connected to an output of the pre-filter, wherein both coding kernels have a separate output, and wherein the controller is operative to activate the coding kernel selected by a coding mode indication, and to deactivate the coding kernel not selected by the coding mode indication or to activate both coding kernels for different parts of the same time portion of the audio signal.

13. Audio encoder of claim 1, further comprising an output stage for outputting the time-varying control signal or a signal derived from the time-varying control signal by quantization or coding as side information to the encoded signal.

14. Audio encoder of claim 1, wherein the controller is operative to provide the time-varying control signal such that a warping operation increases a frequency resolution in a low frequency range and decreases frequency resolution in a high frequency range for the comparatively high warping characteristic of the pre-filter, compared to the small or no warping characteristic of the pre-filter.

15. Audio encoder of claim 1, wherein the controller includes an audio signal analyzer for analyzing the audio signal to determine the time-varying control signal.

16. Audio encoder of claim 1, wherein the controller is operative to generate a time-varying control signal having, in addition to a first extreme state indicating no or only a small warping characteristic, and a second extreme state indicating the maximum warp characteristic, zero, one or more intermediate states indicating a warping characteristic between the extreme states.

17. Audio encoder of claim 1, further comprising an interpolator, wherein the interpolator is operative to control the pre-filter such that the warping characteristic is faded between two warping states signaled by the time-varying control signal over a fading time period having at least two time-domain samples.

18. Audio encoder of claim 17, wherein the fading time period includes at least 50 time domain samples between a filter characteristic causing no or small warp and a filter characteristic causing a comparatively high warp resulting in a warped frequency resolution similar to a BARK or ERB scale.

19. Audio encoder of claim 17, wherein the interpolator is operative to use a warping factor resulting in a warping characteristic between two warping characteristics indicated by the time-varying control signal in the fading time period.

20. Audio encoder of claim 1, wherein the pre-filter is a digital filter having a warped FIR or warped IIR structure, the structure including delay elements, a delay element being formed such that the delay element has a first order or higher order all-pass filter characteristic.

21. Audio encoder of claim 20, wherein the all-pass filter characteristic is based on the following filter characteristic:

$$(z^{-1}-\square)/(1-\square z^{-1}),$$

wherein $z^{-1}$ indicates a delay in the time-discrete domain, and wherein □ is a warping factor indicating a stronger warping characteristic for warping factor magnitudes closer to "1" and indicating a smaller warping characteristic for magnitudes of the warping factor closer to "0".

22. Audio encoder of claim 20, wherein the FIR or IIR structure further comprises weighting elements, each weighting element having an associated weighting factor, wherein the weighting factors are determined by the filter coefficients for the pre-filter, the filter coefficients including LPC analysis or synthesis filter coefficients, or masking-threshold determined analysis or synthesis filter coefficients.

23. Audio encoder of claim 20, wherein the pre-filter has a filter order between 6 and 30.

24. Audio encoder of claim 1, wherein the encoding processor is adapted to be controlled by the controller so that an audio signal portion being filtered using the comparatively high warping characteristic is processed using the second encoding algorithm to obtain the encoded signal and an audio signal being filtered using the small or no warping characteristic is processed using the first encoding algorithm.

25. Audio decoder for decoding an encoded audio signal, the encoded audio signal having a first portion encoded in accordance with a first coding algorithm adapted to a specific signal pattern, and having a second portion encoded in accordance with a different second coding algorithm suitable for encoding a general audio signal, comprising:

a detector for detecting a coding algorithm underlying the first portion or the second portion;

a decoding processor for decoding, in response to the detector, the first portion using the first coding algorithm to obtain a first decoded time portion and for decoding the second portion using the second coding algorithm to obtain a second decoded time portion; and a post-filter having a variable warping characteristic being controllable between a first state having a small or no warping characteristic and a second state having a comparatively high warping characteristic, wherein the post-filter is controlled such that the first decoded time portion is filtered using the small or no warping characteristic and the second decoded time portion is filtered using a comparatively high warping characteristic.

26. Audio decoder of claim 25, wherein the post-filter is set so that the warping characteristic during post-filtering is similar to a warping characteristic used during pre-filtering within a tolerance range of 10 percents with respect to a warping strength.

27. Audio decoder of claim 25, wherein the encoded audio signal includes a coding mode indicator or warping factor information, wherein the detector is operative to extract information on the coding mode or a warping factor from the encoded audio signal, and wherein the decoding processor or the post filter are operative to be controlled using the extracted information.

28. Audio decoder of claim 27, wherein a warping factor derived from the extracted information and used for controlling the post-filter has a positive sign.

29. Audio decoder of claim 25, wherein the encoded signal further comprises information on filter coefficients depending on a masking threshold of an original signal underlying the encoded signal, and wherein the detector is operative to extract the information on the filter coefficients from the encoded audio signal, and wherein the post-filter is adapted to be controlled based on the extracted information on the filter coefficients so that a post-filtered signal is more similar to an original signal than the signal before post-filtering.

30. Audio decoder of claim 25, wherein the decoding processor is adapted to use a speech-coding algorithm as the first coding algorithm.

31. Audio decoder of claim 25, wherein the decoding processor is adapted to use a residual/excitation decoding algorithm as the first coding algorithm.

32. Audio decoder of claim 25, wherein the residual/excitation decoding algorithm include as a portion of the first coding algorithm, the residual/excitation encoding algorithm including, a code-excited linear predictive (CELP) coding algorithm, a multi-pulse excitation (MPE) coding algorithm, or a regular pulse excitation (RPE) coding algorithm.

33. Audio decoder of claim 25, wherein the decoder processor is adapted to use filterbank-based or transform-based or time-domain-based decoding algorithms as a second coding algorithm.

34. Audio decoder of claim 25, wherein the decoder processor includes a first coding kernel for applying the first coding algorithm to the encoded audio signal;

a second coding kernel for applying a second coding algorithm to the encoded audio signal, wherein both coding kernels have an output, each output being connected to a combiner, the combiner having an output connected to an input of the post-filter, wherein the coding kernels are controlled such that only a decoded time portion output by a selected coding algorithm is forwarded to the combiner and the post-filter or different parts of the same time portion of the audio signal are processed by different coding kernels and the combiner being operative to combine decoded representations of the different parts.

35. Audio decoder of claim 25, wherein the decoder processor is, when applying the second coding algorithm, operative to dequantize an audio signal, which has been quantized using a quantizer having a quantization characteristic introducing a quantization noise having a flat spectral distribution.

36. Audio decoder of claim 25, wherein the decoder processor is, when applying the second coding algorithm, operative to dequantize quantized time-domain samples, quantized subband samples, quantized frequency coefficients or quantized residual samples.

37. Audio decoder of claim 25, wherein the detector is operative to provide a time-varying post-filter control signal such that a warped filter output signal has a decreased frequency resolution in a high frequency range and an increased frequency resolution in a low frequency range for the comparatively high warping characteristic of the post-filter, compared to a filter output signal of a post-filter having a small or no warping characteristic.

38. Audio decoder of claim 25, further comprising an interpolator for controlling the post-filter such that the warping characteristic is faded between two warping states over a fading time period having at least two time-domain samples.

39. Audio decoder of claim 25, wherein the post-filter is a digital filter having a warped FIR or warped IIR structure, the structure including delay elements, a delay element being formed such that the delay element has a first order or higher order all-pass filter characteristic.

40. Audio decoder of claim 25, wherein the all-pass filter characteristic is based on the following filter characteristic:

$$(z^{-1}-\square)/(1-\square z^{-1}),$$

wherein $z^{-1}$ indicates a delay in the time-discrete domain, and wherein □ is a warping factor indicating a stronger warping characteristic for warping factor magnitudes closer to "1" and indicating a smaller warping characteristic for magnitudes of the warping factor closer to "0".

41. Audio decoder of claim 25, wherein the warped FIR or warped IIR structure further comprises weighting elements, each weighting element having an associated weighting factor, wherein the weighting factors are determined by the filter coefficients for the pre-filter, the filter coefficients including LPC analysis or synthesis filter coefficients, or masking-threshold determined analysis or synthesis filter coefficients.

42. Audio decoder of claim 25, wherein the post-filter is controlled such that the first decoded time portion is filtered using the small or no warping characteristic and the second decoded time portion is filtered using a comparatively high warping characteristic.

43. Digital storage medium having stored thereon an encoded audio signal, comprising:

a first-time portion encoded in accordance with a first coding algorithm adapted to a specific signal pattern;

a second time portion encoded in accordance with a different second coding algorithm suitable for encoding a general audio signal; and as side information, a warping factor indicating a warping strength underlying the first or the second portion of the encoded audio signal.

44. Digital storage medium in accordance with claim 43, in which the encoded audio signal further comprises, as side information, filter coefficient information indicating a prefilter used for encoding the audio signal or indicating a post-filter to be used when decoding the audio signal.

45. Method of encoding an audio signal, comprising:

generating a pre-filtered audio signal using a pre-filter, the pre-filter having a variable warping characteristic, the warping characteristic being controllable in response to a time-varying control signal, the control signal indicating a small or no warping characteristic or a comparatively high warping characteristic;

providing the time-varying control signal, the time-varying control signal depending on the audio signal; and processing the pre-filtered audio signal to obtain an encoded audio signal, in accordance with a first coding algorithm adapted to a specific signal pattern, or in accordance with a second different encoding algorithm suitable for encoding a general audio signal.

46. Method of decoding an encoded audio signal, the encoded audio signal having a first portion encoded in accordance with a first coding algorithm adapted to a specific signal pattern, and having a second portion encoded in accordance with a different second coding algorithm suitable for encoding a general audio signal, comprising:

detecting a coding algorithm underlying the first portion or the second portion;

decoding, in response to the step of detecting, the first portion using the first coding algorithm to obtain a first decoded time portion and decoding the second portion using the second coding algorithm to obtain a second decoded time portion; and post-filtering using a variable warping characteristic being controllable between a first state having a small or no warping characteristic and a second state having a comparatively high warping characteristic, wherein the post-filtering is performed such that the first decoded time portion is filtered using the small or no warping characteristic and the second decoded time portion is filtered using a comparatively high warping characteristic.

47. Audio processor for processing an audio signal, comprising:

a filter for generating a filtered audio signal, the filter having a variable warping characteristic, the warping characteristic being controllable in response to a time-varying control signal, the control signal indicating a small or no warping characteristic or a comparatively high warping characteristic, wherein the filter is a linear filter which is, dependent on the control signal, implemented as a pre-filter or a post-filter for filtering to amplify or damp psychoacoustically more or less important portions, or implemented as an LPC analysis or synthesis filter; and a controller for providing the time-varying control signal, the time-varying control signal depending on the audio signal.

48. Audio processor of claim 47, in which the linear filter is a low pass filter.

49. Method of processing an audio signal, comprising:

generating a filtered audio signal using a filter, the filter having a variable warping characteristic, the warping characteristic being controllable in response to a time-varying control signal, the control signal indicating a small or no warping characteristic or a comparatively high warping characteristic, wherein the filter is a linear filter which is, dependent on the control signal, implemented as a pre-filter or a post-filter for filtering to amplify or damp psychoacoustically more or less important portions, or implemented as an LPC analysis or synthesis filter; and providing the time-varying control signal, the time-varying control signal depending on the audio signal.

50. Digital storage medium having stored thereon a computer program having a program code for performing the method of claim 45, 46 or 49, when the program code is running on a computer.

* * * * *